United States Patent [19]

Lehmacher et al.

[11] 4,011,978

[45] Mar. 15, 1977

[54] PLASTIC BAG MACHINE

[75] Inventors: Hans Lehmacher, Niederkassel-Mondorf; Heinz-Eugen Klüppel, Niederkassel-Lulsdorf; Karl Dreckmann, Hennef-Sieg-Altenbodingen, all of Germany

[73] Assignee: Hans Lehmacher, Niederkassel-Mondorf, Germany

[22] Filed: July 24, 1975

[21] Appl. No.: 598,775

[30] Foreign Application Priority Data

Aug. 2, 1974 Germany ..... 2437325

[52] U.S. Cl. ..... 226/142; 226/156

[51] Int. Cl.[2] ..... B65H 17/22

[58] Field of Search ..... 226/137, 141, 142, 156, 226/157, 32, 33

[56] References Cited

UNITED STATES PATENTS

| | | | |
|---|---|---|---|
| 2,262,915 | 11/1941 | Bobst | 226/142 |
| 3,089,345 | 5/1963 | Budlong | 226/142 X |
| 3,650,449 | 3/1972 | Mundus | 226/142 |

*Primary Examiner*—Richard A. Schacher
*Attorney, Agent, or Firm*—P. D. Golrick

[57] ABSTRACT

High production rates and decreased wear and tear and stress on parts are obtained in a bag fabrication machine with the web fed intermittently by respective bag lengths, for operations such as perforating, transverse severing or welding with the web halted.

A sector plate is oscillated between two extreme positions faster in one direction than in the other by a flywheel-carried crank pin orbiting about an axis eccentric from the plate axis; the pin engaging a block sliding in the plate radially of its axis. The plate motion is applied as input to an electrically operated clutch and brake unit and the output is applied to web advance rolls. Switches on the slide block, actuated at the extreme sector positions, control the alternating clutch and brake engagement to drive the rolls for web feed during the slower sector motion of relatively longer duration; and also declutching with braking to halt the web precisely, for and during a faster sector plate return motion. Web feed length, hence bag length, is selected by adjustment of the crank pin orbit radius.

16 Claims, 8 Drawing Figures

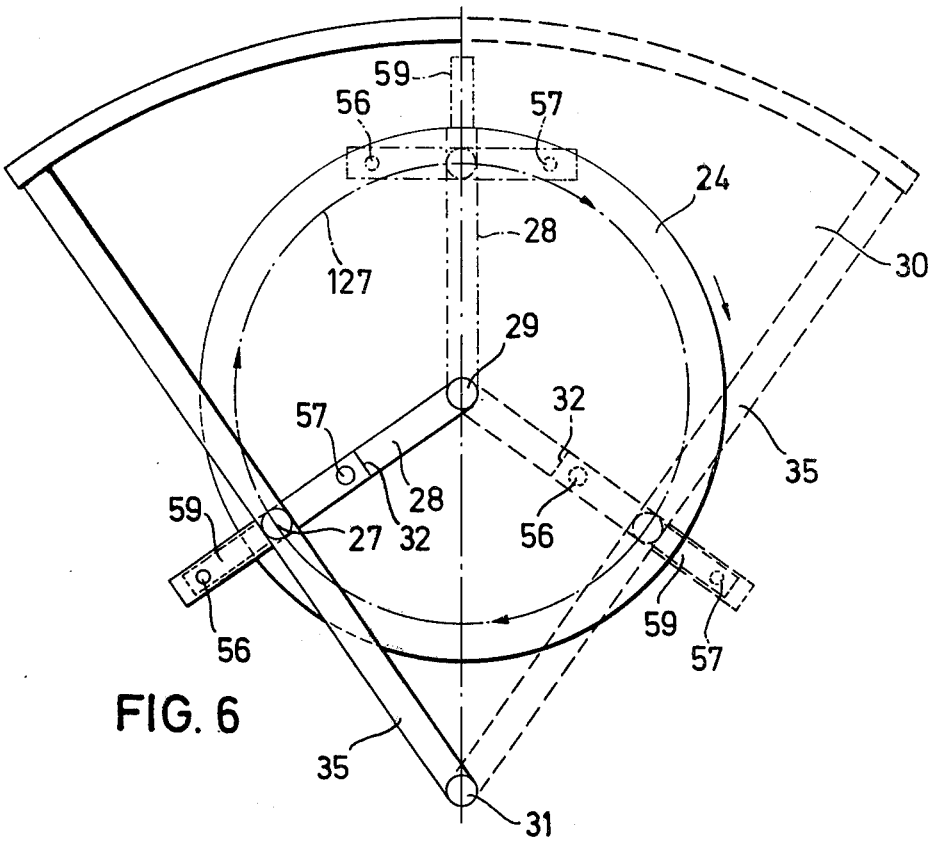
FIG. 6
FIG. 7
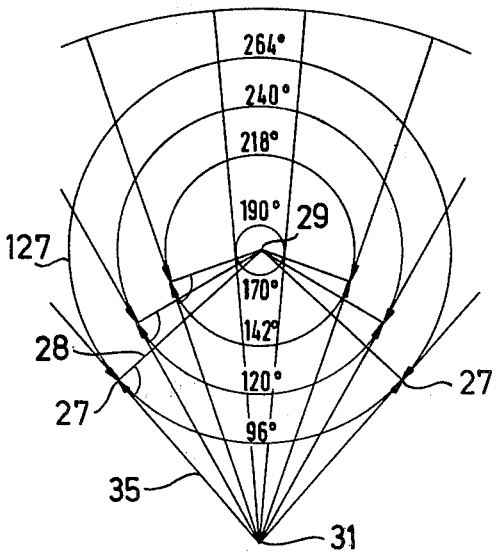

PLASTIC BAG MACHINE

GENERAL DISCUSSION

The present invention is concerned with a machine provided with a web feed mechanism for intermittent web advance in predetermined lengths by intermittently driven feed rolls, which in turn are driven by an oscillating crank drive. The intermittent web feed is used, because certain work operations can be performed only when the web is stationary, for example, in a plastic bag making machine, perforating the web, or making cuts or welded seams running transversely of the feed direction.

Among known mechanisms for this purpose in one arrangement the feed rolls are driven by an oscillating or swinging crank drive, so that this roll drive undergoes an oscillating rotational motion, during one motion or phase of which a driving member and the web feed device are coupled by a clutch to advance the film web by a predetermined length. During the other motion phase, the drive transmission to the feed rolls is declutched so that the reverse motion of the drive train is not transmitted to the feed rolls and to the web.

On the one hand to prevent an undesirable coasting or overrun of the feeding device, by the inertia of the moving parts, and on the other hand, to halt the web after an exactly equal length advance, for example, in response with a control mark imprinted on the web, the web advance mechanism usually is also provided with a conventional brake. Thus during the one motion phase of the drive, the clutch is activated; and for the other phase, the brake.

In the above-described prior mechanism, the gear wheel of the roll drive transmission is turned in one and in the other rotational direction with like patterns of peripheral velocity, because the crank swing arm moves with like motions in opposite directions. Consequently the driven web advance rolls operate in a cycle in which they are rotating and halted for equal periods.

Although practically not needful or useful, this equality of the driving and stationary periods limits the production capacity of the machine, since the transverse cutoff and/or transverse severance welding of many films does not take as long as the time necessary for the film advance. Especially is this true where long film sections are to be fed which need a corresponding longer time for their feed advance.

Furthermore, in prior mechanisms of the type described, with forward and reverse motions of the crank swing arm, and also of the gearing thereby driven, occurring within like time intervals, the result is that during accelerated operation, the gearing is highly stressed in consequence of the mass accelerations and decelerations involved. These machine components and also their supports then must be correspondingly heavily structured of high strength metal.

Machines incorporating the invention are characterized by a very quite operation.

One object of the invention therefore is to provide a machine generally of the type described with a web feed or advance through intermittently operating rolls driven by an oscillating crank driver, in which the period for operation of the roll drive is longer than the time interval when the roll drive is stationary. Consequently the parts may be designed with lighter construction and there is a shorter stationary phase of the feeding mechanism during which, for example, in a plastic bag making machine, transverse severance welding and/or a simple severance cut may be effected.

Another object is to enable changing and quite accurately establishing the time ratio of the driving phase to the stationary phase.

To achieve these ends in a machine of the character described in which an intermittent web advance device is drivable by an intermittently driven transmission system through a belt from a crank oscillated lever, in accordance with the invention, an oscillated lever arm and a crank disk are supported in overlapping relation; and a slide block, radially shiftable on the crank swung lever relative to the lever pivotal axis, is engaged by a crank pivot pin secured on a screw adjustment spindle in the crank disk.

The crank-oscillated lever comprises a sector plate with slide block supporting guide rods symmetrically centrally located thereon; and an endless toothed belt anchored centrally on its arcuate periphery is reeved about an idler and a toothed wheel on the input of an electro-magnetically actuated clutch and brake unit, of which an output shaft wheel engages a second belt to the web advance rolls, so that of the opposite sense rotational motions developed in the input wheel by the sector belt, motion of one sense only is coupled to the rolls by appropriate clutch actuation.

With this arrangement, the crank-oscillated lever arm swings in one direction more slowly than in the other, so that the web feed roll pair has a time interval for drive rotation, and thereby for the web advance, longer than the stationary interval, during which the film web is halted for an operation to be performed.

By thus feeding the web over a time interval longer than its stationary period, a high machine production capacity is attained. Concomitantly, a reduction in stressing of the drive transmission parts is obtained, because with a larger part of the work feed cycle available for and devoted to the web feed, a relatively lower acceleration of the moved parts is possible for a given production rate.

Respective electric switches supported on opposite sides of the slide block enable an exact actuation control of a clutch and brake unit whereby the clutch affords the web advance drive of, and the brake ensures the stationary condition of, the feed rolls.

Through these expedients accordingly an exact operation is possible through precise maintenance of the times for driving and for halting the web. Moreover, through the switches thus disposed, the clutch and the brake can be brought into operation, with a partial acceleration or delay, so that in addition to the web feed length change and selection, possible through adjustment of the crank pin radial spacing from the disk rotational axis, the possibility of register correction is available.

A third switch also may be located on the slide block, for turning on and off a photocell control system of the machine, in such manner that the photocell control becomes operative, when a web portion upon which an operation is to be performed is in the region of the work station. Thus the photocell control of say the transverse severing or welding or other operation to be carried out is made more precise. For the photocell control then only senses those control index marks imprinted on the web which are disposed in the web region where the operations are to be carried out. Since an index mark sensing control can respond to various possible color differences on an imprinted film web length, this expedient avoids various difficulties, for the control sensor is by the described means able to respond only to those marks located close to the region where the operation is desired to occur.

Proximity initiator type switches are preferably used, i.e., electrical signal producers of which the current conductivity can be changed in a reaction free manner by metal element coming into proximity thereto. These devices have a relatively high resistance and a low resistance respectively with proximity to or greater spacing from the metal, so that the difference in resistance is used for control purposes.

Preferably the switches control element is disposed on a member adjustably supporting the crank-pin on the crank disk, with the two switches secured on opposite sides of the slide block. Reed switches also may be used for which the actuating element is a small permanent magnet, or a magnetic shunt which perturbs a permanent magnet field otherwise constantly applied to the reed switch.

There is obtained in effect a relative rotation of the element relative to the slide block, while the switches along with the slide block reciprocate radially on the crank lever, in combination with the oscillating tilting motion of the latter. Thus each switch is actuable once in the drive cycle, so that by known types of control circuitry the clutch is electrically engaged and released and the brake deenergized and energized in the cycle; while the crank disk is continuously driven by a toothed belt from a continuously operating motor.

Other objects and advantages of the invention will appear from the following description and the drawings of the particular embodiment of the invention; wherein:

FIGS. 6 and 7 are diagrams explanatory of the principles of operations.

GENERAL STRUCTURE AND OPERATION

Figure 1:
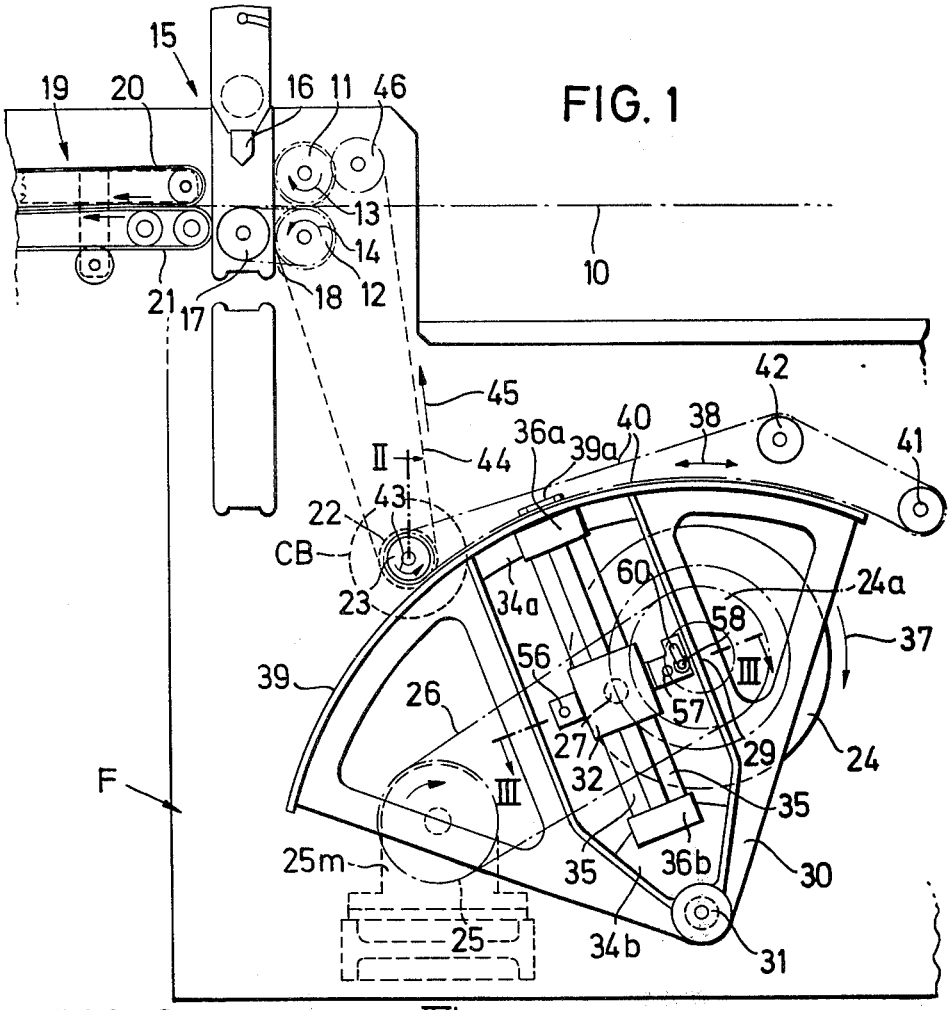
FIG. 1 is a side elevation of an automatic plastic bag making machine embodying the invention with part of the conventional discharge mechanism shown in fragmentary form, with certain components merely outlined and others omitted, more clearly to show the general organization.

FIG. 1 shows the general arrangement of a plastic film bag making machine as one embodiment incorporating the invention.

From a web source, (not shown), for example, a supply roll of flattened tubular thermoplastic synthetic film, a continuous web 10 is fed, between the upper and lower feed advance rolls 11–12 rotating as indicated by arrows 13, 14, to the work station 15 for an operation requiring the web to be halted, such as transverse web severance or a seam welding, performed by the wedge-shaped vertically reciprocating weld seaming or severing bar 16 cooperating with the anvil roll 17 rotatable about a fixed axis. A finished bag discharge device 19, of per se known form is provided by the parallel arrays of upper and lower delivery tapes 20–21 for conveying severed individual web sections away from station 15.

The rolls 11–12 are intermittently driven to advance the leading end of web 10 by a predetermined section length increment, for example, which corresponds to the length of a bag to be produced passing it under and beyond the severing end seam welding device, between the opposed parallel reaches of the preferably continuously running tapes 20 and 21.

The rolls 11–13 and anvil roll 17, say belt connected at 18 to 12, are driven intermittently by a toothed wheel or gear 22, in FIG. 1 disposed behind the toothed wheel 23, (see also FIG. 2), through a drive transmission belt 44 reeved over an idler wheel 46 and then between the peripheries of the rolls 11–12, or of toothed wheels on roll shaft ends, in such sense that belt motion in the direction 45 communicates rotations 13–14 to the feed rolls.

Toothed wheel 22 is driven intermittently in one sense only as the output of a clutch-brake unit CB (hereinafter more particularly described to FIG. 2), the toothed input wheel 23 of which is alternately driven successively, first with rotations in one sense then in the other, by toothed belt 40 anchored on the arcuate rim periphery of a sector member 30 oscillated about a hub pivot 31 at the sector apex or center by the continually orbiting crank pin 27 carried on the crank disk 24 with shaft 29 rotatably supported relative to machine frame F, and continuously driven by electric motor 25 in through belt 26.

Structure and control of unit CB, whereby the intermittent rotational motion is picked off, are later explained, as are details of structure and mode of operation of the driving mechanism for the feed rolls.

SECTOR CRANK DRIVE MECHANISM

The crank disk 24, providing also a flywheel effect, is supported (see also FIG. 4) on one end of its shaft 29 journalled in bearing **24*b* bolted to a frame side plate; and keyed on the other rearward outboard shaft end, a toothed sprocket or gear wheel 24*a* is driven by a sprocket chain or belt 26 from a similar motor shaft sprocket or wheel 25.**

Crank pin 27 drives quadrant shaped sector element 30 as a swinging lever arm by pivotal engagement in a slide block 32 reciprocatable on a sector-supported slideway provided by parallel guide rod members 35—35. Thus block 32 is guided slideably along the sector radial center line, also a line of symmetry for the sector.

The resultant sector plate oscillation, to and fro in the directions indicated at 38, draws back and forth the reinforced flexible toothed belt 40 secured to the outer face of sector rim 39 by anchor clamping device **39*a*, and reeved over the wheel 23, a support idler wheel 41, and an intermediate tensioning idler wheel 42.**

Accordingly oscillatory or swinging motion at the sector periphery is communicated to and converted to rotational motion at wheel 23, first with the rotation in one sense, in the direction 43, when the sector is moving clockwise, and then in the opposite rotational sense, for the opposite swing.

Conveniently the wheels 41 and 23, located outside of the sector rim, are of the same diameter with axes parallel and equally spaced from the sector pivot axis at 31. In any event the wheel peripheries are appropriately spaced from the coaxial roughly quarter-cylindrical extent of the outer surfaces of sector rim 39 in view of belt thickness, so that generally the belt 40 reaches approximately tangently (during most of the motion) between the sector rim and the wheels 41 and 23. In contrast with wheels 23 and 41 with fixed axes, idler wheel 42 preferably is adjustably supported on the frame for belt take up as needed.

Transmission of motion from wheel 23 ultimately to rolls 11–12 is provided through a clutch in the aforementioned unit CB, to wheel 22, thence to belt 44 to the rolls 11, 12; to produce the requisite increment of web advancing motion during the sector swing to the right; with the wheels 22, 23 being declutched during for the sector return stroke. The wheel 23 is appropriately braked under controls and by the detailed elements hereinafter described.

CRANK PIN MOUNTING

Figure 3:
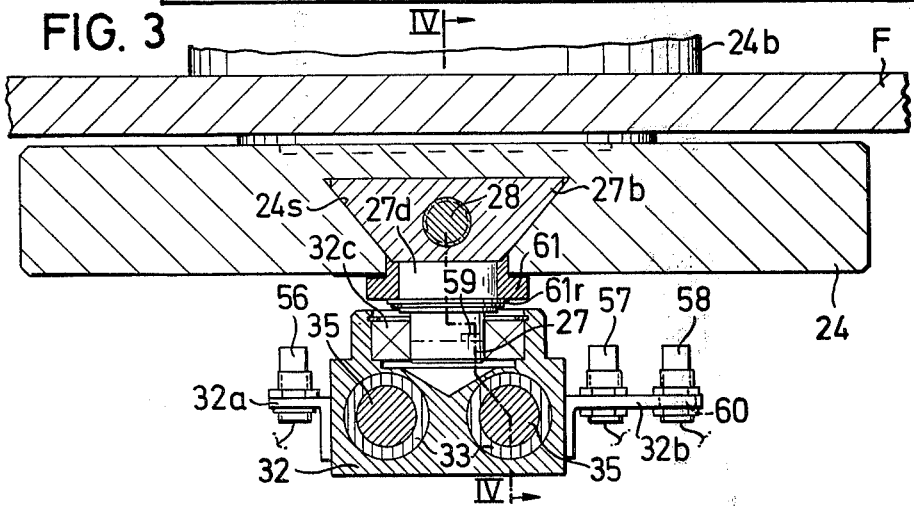
FIG. 3 is an enlarged fragmentary detail section taken at line III—III in FIG. and, with respect to slide block and switch mount structure, at line III—III in FIG. 1.
Figures 4, 4A, 5:
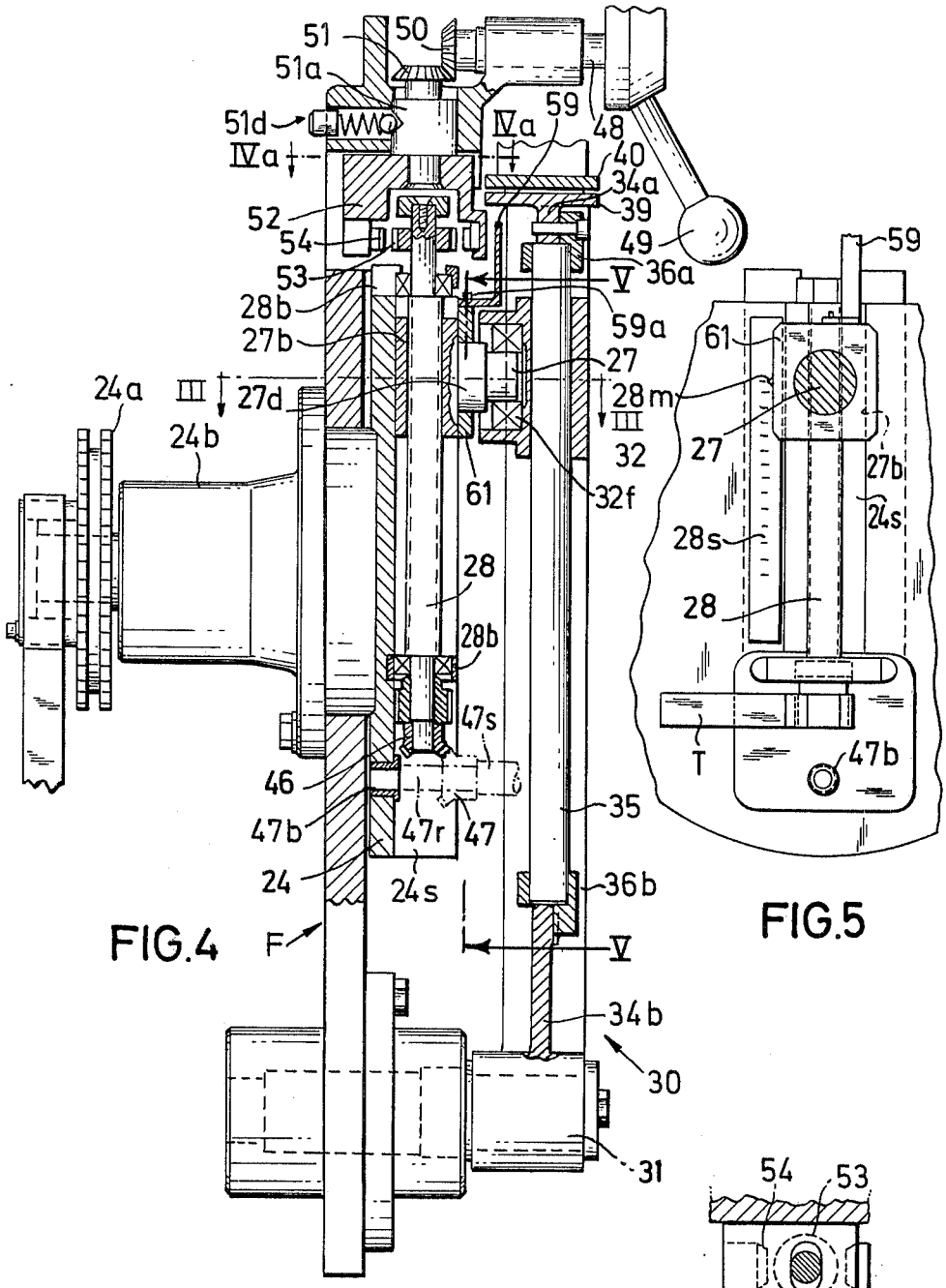
FIG. 4 is an enlarged fragmentary section taken in vertically through the mechanism of FIG. 1 with however certain moving components at a somewhat different position from that of FIG. 1.
FIG. 4a is a detail sectional view taken at the line IVa—IVa in FIG. 4.
FIG. 5 is a further fragmentary view taken at the line V—V in FIG. 4, and also presenting a minor modification of a crank pin positioning adjustment means.

The adjustable block mounting of the crank pin 27 is to be gathered particularly from FIGS. 3, 4 and 5.

In disk 24, a diametric face-slot at 24*s*, having preferably inwardly sloping sides, retains a crank pin base 27*b* of mating cross section, with which the crank pivot pin 27 is integral. A lead-screw like spindle screw 28, engaged in a threaded longitudinal base bore and rotatably supported at opposite ends in bearings 28*b*—28*b* on the disk, afford means for changing the position of crank pin securement, i.e., the radial spacing between the pin and disk aces, by screw rotation means to be described, thus to change the crank pin throw, hence the sector swing amplitude. This adjustment changes the extent of rotary motion in, and the speed of the web advance at, rolls 11–12, thus and ultimately the web feed or bag length, if other parameters of mechanisms be unchanged; and also may be used as one means of correcting web register.

This adjustment may be effected manually when the machine is out of operation; or under manual control, while the machine is running, as hereinafter explained.

As seen in FIG. 5, the facilitate manual setting the crank pin position or bag length selection, an appropriate scale 28*s* may be inscribed or applied adjacent the slot 24*s*, for use with a pointer or index mark 28*m* on the adjacent side of plate 61 which is received about a larger diameter 27*d* between the crank pin base and pivot and overlaps the slot edges. Scale 28*s* may be graduated in units of radius or of web feed lengths.

On the rear face of plate 61 (see FIG. 3) at least projecting margins are receiving between the slot edges for plate guiding and orientation purposes. Plate 61 also may be retained (see FIG. 3) by snap rings 61*r*.

CRANK PIN RADIAL SETTING

In FIG. 4, on the reduced projecting upper and lower ends of the screw 28 respectively, there are keyed otherwise secured a bevel gear 46 and a spur gear 53.

Bevel gear 46 is meshingly engageable by a bevel pinion gear 47, as for example, on a removable manually rotatable adjustment tool shaft 47*s* supported at right angles to screw 28 by insertion of the reduced inner shaft end 47*r* in a locating and support bushing 47*b* in the slot bottom. By this means, for example, the screw 28 is manually rotatable to adjust the crank pin position when the machine is not running.

Also as shown in FIG. 5, a box wrench type tool T may be applied to an appropriately shaped head, e.g., a hexagonal head, formed in the lower end of spindle 28, for manual adjustment of pin position.

Further, in FIG. 4, on the upper end of screw 28 there is also shown mechanism for crank pin positioning adjustment while the machine is running.

A horizontal shaft 48, supported on the frame for rotation by handle 49, on its inner end bears a bevel gear 50 meshed with bevel gear 51 on the upper end of a short vertical shaft 51*a* with axis near the axis of screw 28, and in turn engaged with a claw element 52, the lower end of which has opposed teeth 54 on opposite sides of the path transversed by spur gear 53 projecting beyond the disk edge. Depending upon the rotational motion applied to 51*a* from handle 49 to shift the element 52 and the corresponding engagement of the toothing 54 with the orbiting spur gear 53, there is produced a rotation of the spindle 28 in one or the other direction, and a corresponding change in the radial position of crank pin 27.

For this purpose (see also FIGS. 4*a*) member 52 may comprise a block supported in the machine frame to shift slightly to left or right in FIG. 1 and FIG. 4*a* i.e., perpendicular to the plane of disk 24; and having a transverse slot engaged by a slightly eccentric bottom projection of shaft 51*a*, so that rotation of shaft 51*a* in one or the other sense brings the teeth 54 into the path of the teeth of gear 53, on one or the other side of the gear 53. Thus with each rotation of disk 24 during the adjustment, as gear 53 swings through member 52, it encounters teeth 54 and is rotated, hence screw 28 is rotated, a fraction of a turn, the extent depending upon whether one tooth or in opposed parallel rack-like arrangements two or more teeth are provided on the claw member. A detent device 51*d* of spring and ball type, engageable in a notch of 51*a*, holds the device in the neutral position shown in FIG. 4.

CRANK PIN SLIDE BLOCK

Rather than a simple pin-and-slot engagement between the crank pin and sector plate the following structure is used.

The slide block 32 has a generally symmetrical structure (see FIGS. 1 and 3). Two parallel guide rods 35—35, secured in symmetrical, spaced relation to the radial center line of the sector 30, extend through slide bearing bushings 33 in two parallel bores of slide block 32. The outer and inner clamp plates at 36*a*, 36*b* secure the opposite rod ends to outer and inner web portions 34*a*, 34*b* of the sector plate. Switch mounting brackets 32*a* and 32*b* are secured on opposite sides of the block, with coplanar arm portions in alignment on a line transverse to the block.

The reduced end 27, the effective crank pin pivot, is received in bearing 32*c* in a central recess of the back face of the slide block. The axis of this bearing, centrally located in the block, and with which the crank pin pivot coincides, is here for convenience at times termed the center or axis of the block. Thus the design and disposition of parts is such that the axis of the crank pin moves in its reciprocating motion along the radial center line of the sector.

BRAKING AND CLUTCHING UNIT

Figure 2:
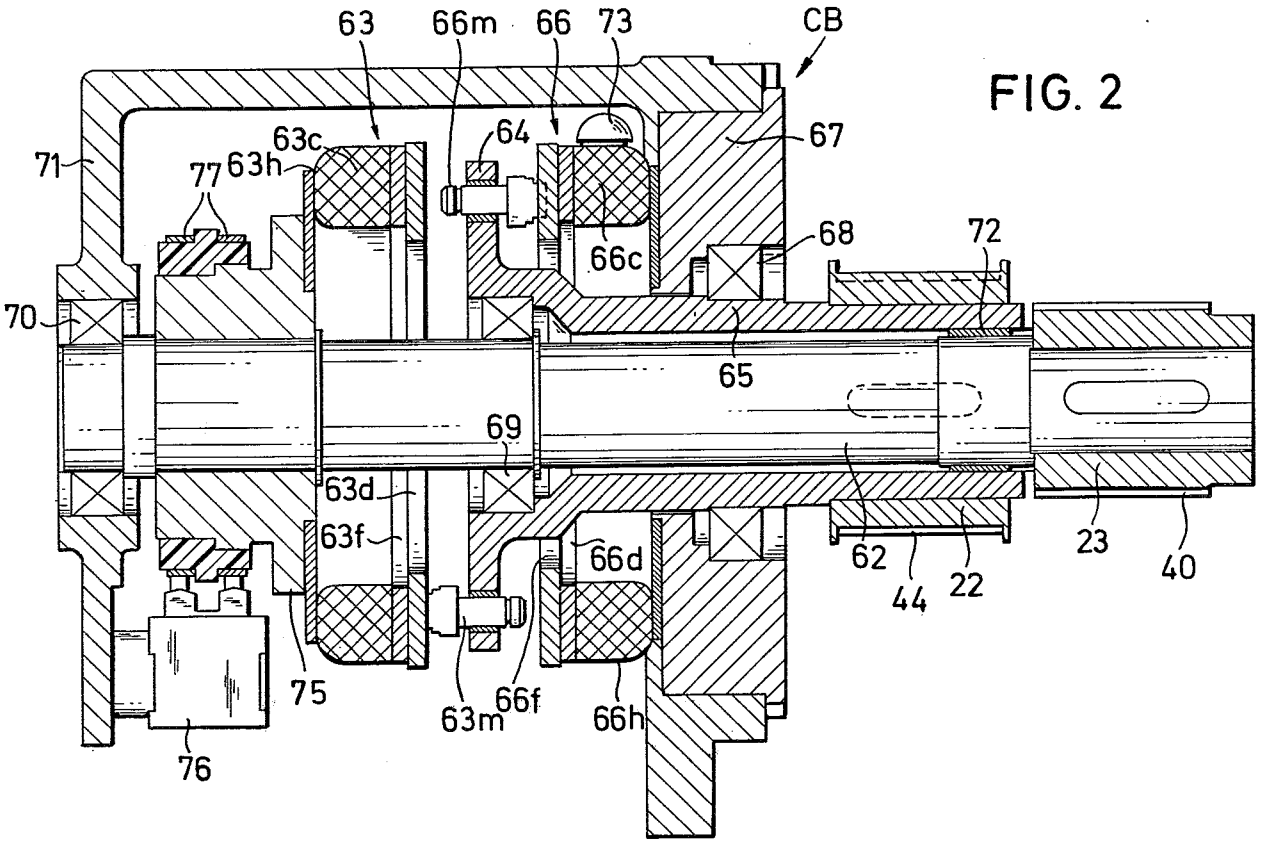
FIG. 2 is an enlarged detail view, a vertical axial section taken at II—II in FIG. 1 through a clutch and brake sub-assembly.

The large scale FIG. 2 shows the main components of the electrically actuated and controlled clutch and brake unit CB for selectively or periodically bringing with input at toothed wheel or gear 23 into a driving relationship with the tooth wheel or gear 22 to produce web feeding motion, and alternately to brake the drive transmission to the feed rolls.

The input gear 23 engaged by belt 40 is keyed to a shaft 62 extending through a quill 65 as an output shaft rotatably supported in the unit housing end wall 67 by bearing 68. The shaft 62 is supported by bearings 69–70 respectively in a recess of the flanged inner quill end 64, and at its inboard end in the unit housing wall portion 71; and also by a sleeve bearing 72 in the quill outboard end, on which end is keyed the output toothed wheel or gear 22 engaging with belt 44 for the drive ultimately to the rolls 11–12. The housing of the unit CB, securely mounted on the machine frame, has further enclosing and sealing structure not shown.

The clutch and brake sections 63, 66 comprise annular electromagnetic units, identical in structure and located in the spaces between the end walls and the quill flange. Hence elements in 66 like to those in 63 have like literal suffixes in their reference numerals.

However, the housing 63h is rotatable with shaft 62 while the brake housing 66h is fixed to wall 67. Hence the brake has merely a conventional wiring entry at 73, but for the clutch section 63, secured on a keyed shaft hub 75, there is required a rotating electrical connection. This is provided by a wall-mounted brush pair holder 76 cooperating with two slip rings 77 supported by an insulating annulus on hub 75.

Though these electromagnetic sections may take various forms, essentially each is comprised, as in the clutch section 63, of a housing or casing containing energizing winding **63*c*, and one (or more) annular friction disks in, or as a facing 63*f* on, the housing 63h; and, aligned to cooperate therewith, one, 63*d*, or more, friction disks carried by, or carrying, a connecting member or means 63*m* connecting to the quill. Here the said shiftable friction disks, as 63*d*** include iron elements thereby to be magnetically attractable in armature-like fashion by the energized winding.

The clutch housing **63*h* is affixed to shaft hub 75, and the connecting member means 63m is connected to the quill at flange 64, for the shaft 62 and quill 65 as the two relatively rotatable elements which are to be releasably coupled or engaged for clutching. But as quill 65 and housing wall 67 are the relatively rotatable members for braking function, the connecting means 66m and the brake housing 66h are connected respectively to the quill flange and wall 67.**

Since the cooperating friction members may merely slip relative to one another, while the respective winding is not energized to bring them into frictional engagement, or they may be spring biased either into or out of engagement, the term "electrically actuated" (or "activated") is defined herein to mean "brought into engagement", or into "activity" of the clutching or braking function by setting of an electrical condition, whether energizing or deenergizing.

To provide the connection means of each section, the respective annular friction disks **63*d* and 66*d* bear a plurality, preferably at least three of spaced pins 63*m* and 66*m* axially slideably engaged in respective angularly and radially equispaced bushed through -apertures in quill flange 64, which effectively supports these friction members 63*d* and 66*d*** for slight axial shift into engaged condition by electromagnetic attraction upon winding energizations.

When the clutch electromagnet coil **63*c* is energized or electrically activated, clutch shaft 62 is coupled or connected to the quill flange 64, hence to the toothed wheel 22, and belt 44** is accordingly driven to drive the feed rolls.

If the clutch, however, is disengaged, i.e., its power turned off; and the brake 66 then engaged, i.e., its coil energized, then since the brake housing is effectively anchored to the machine frame, the quill flange 64 is braked, and accordingly so also the toothed wheel 22, the belt 44 and the elements thereby driven to stop the transmission drive system from 22 to rolls 11, 12, 17, hence bringing the web to a quick precise halt.

CONTROL SWITCHES-FEED CYCLE CONTROL

In FIG. 1, there appears (see also FIG. 3) a set of three proximity switches 56, 57, 58 supported on brackets **32*a*, 32*b* on slide block 32, with 56 and 57 disposed along a line transverse to the slide guide rods 35, and therefore perpendicular to the direction of slide reciprocation. These switches, of which compact preferred forms are described in the introduction, have the form of "initiator" switches, for appropriately timing the clutch and brake action in the case of 56, 57. These cooperate with a switch activator or triggering control elements 59, merely indicated in dotted lines in FIG. 3.**

Element 59, is more clearly seen in FIG. 4, as having an L-shape, with a base leg secured by a screw **59*a* on the crank pin associated plate 61, with the active element extending outwardly beyond the disk edge, being offset from plate 61 toward the switches, and being generally in "alignment" with the slot 24s and screw 28,** though slightly off to one side of the slot centerline.

Thus with the orbiting motion of the crank pin, there is in effect a continuous angular swinging of the element 59 extending radially from the axis of the bearing of the slide block resulting in triggering of the switches alternately and in the manner of operation schematically represented in and later described relative to FIGS. 6–7.

MODE OF OPERATION - FIG. 6

In schematic FIG. 6, the flywheel-crank disk 24; the adjustment screw 28 as representative of the disk radius on which the pin 27 is located and also of the location of switch activating element 59; the slide block 32; and in fragmentary form, sector member 30, are schematically represented; the latter in part by the effective radial path, relative to the sector pivot axis 31, of the slide block and crank pin axis, which path is designated 35 since defined by slide guide members 35. This path lies along the radial centerline of the sector member. From the disk shaft axis 29, also 28 and 35 are shown extending upwardly at its position midway in the feed phase part of the cycle.

On elongated rectangle 32 representing the slide block in which the crank pin 27 is engaged, there are imposed circles 56 and 57 representing the switches of like numerals; while the switch activating element 59 is represented in its relative position aligned with and as though an extension of screw 28.

The dashed circle 127 is the orbit circle path for the pin axis for a particular crank pin setting, on the screw 28, of its radial position, i.e., relative to the crank rotational axis 29.

For the given crank pin orbit radius, the slide path 35 (hence the sector centerline) is shown (in full lines at the left, dotted at the right) at its two extreme swing positions, where screw 28 is perpendicular thereto.

With the continually orbiting crank pin 27 pivotally connected with or engaged in the slide block 32, the latter necessarily corresponding slides along the guide rods 35, and oscillates the sector 30. Hence the belt 40 drives the input wheel 23, in a motion converting arrangement converting for the swing oscillating motion of the sector into a rotary motion of wheel 23 reversing in sense with the sector swing reversals.

The switch activator 59, since fixed relative to the crank pin base, in effect rotates or swings about the slide block center relative to the block and the switches thereof; and thus has a continuous seeming swing about the crank pin, since the crank pin axis and block center coincide.

With clockwise disk rotation as shown, the web is to be fed by the sector swing to the right, and the left switch 56 (FIGS. 1 and 6) serves as means for producing a signal for the control system, to energize and engage the clutch and to keep it engaged, also to release the brake. Hence the right switch 57 serves as means for producing a signal for the control system to release the clutch, and for energizing and engaging the brake, and to keep it engaged until 56 again energizes the clutch.

At the left, where screw 28, hence the radius from disk axis 29, has become perpendicular to the sector centerline, the passing switch activator 59 overlaps and triggers the switch 56, and thereby accordingly engages the clutch 63 for a torque-secure connection of the wheel 23 with the wheel 22.

In the ensuring clockwise sector movement with the clutch thus engaged, the wheel 23, being driven by belt 40 in the indicated arrow direction 43 in FIG. 1, is coupled with the wheel 22, so that its motion drives the web advance feed rolls 11–12 through the transmission system provided through the clutch in unit CB, wheel 22, and belt 44 moving in direction 45.

When the crank-swung sector reaches the right dotted line position, with 28 perpendicular to 35, then the activator 59 passes and actuates switch 57 producing the control signal which first deenergizes and disengages the clutch 60, releasing wheel 23 from the transmission to the rolls, and secondly activates the brake 66, so that the transmission system and thus the advance rolls are abruptly braked to have no effective overrun. Thus the return motion of the sector, counterclockwise to the left,is not communicated to the now halted feed rolls.

Of course, the transverse switch position line may actually have an angular position other than at right angles to the block travel, i.e., the slide centerline, if the position of element 59 is correspondingly shifted, so that actuation of switches 56, 57 still occurs when 28 becomes perpendicular to 35, at least for the above described operation obtaining clutching and braking at the sector extreme positions.

In FIG. 6, it is apparent that, between the two represented sector swing end positions, the upper arc of the pin orbit circle 127 extends over a larger angle than the lower arc. Since the crank disk rotates with substantially uniform velocity, these arcs are also a measure of time; and it follows that the sector swing in the clockwise direction for web feed, requires a longer interval of time than the return swing.

Therefore there is a reduction of the acceleration and deceleration of these feed mechanism components, which move during web feed and are stationary with the web halted, in comparison with a system allocating equal intervals for the feed and stationary conditions of the web; and those components then are spared stressing to a corresponding degree.

The upper and lower arcs then obviously are measures of the part of each web advance cycle available for web feed and, with the web halted, for carrying out operations thereon as previously described.

But then also there is a possibility of operating the bag making machine with a higher working rate than hitherto; because relatively and in reality, a smaller time interval can be provided when the web is halted for the film welding, than that required for film advance.

Moreover, by the invention, in combination with the switches which are carried on the sector rather than on the frame, it is possible exactly to establish coupling-clutching and braking times; and the length of a bag to be fabricated may be regulated quite closely. Furthermore through a possible displacement of the initiator switch on the slide block, or through a time delay relay, it is possible to make further changes in the feed cycle time allocations, as noted below, or to make corrections for example in register.

FIG. 7

FIG. 7 shows schematically, first crank pin orbit circles for various settings of the crank pin 27, hence the slide block 32. from the crank disk axis 29; and secondly, the change in the proportion of the upper arc to respective lower arcs in those circles between the points representing the crank pin axis positions when the sector member has reached its maximum excursion to each side.

Since these are the positions where sector velocity has become zero, before swing reversal ensuing, obviously they establish moments in time of cycle or places in geometry at or near which clutch and braked actuations or deactuations are to be effected.

Those points are established by tangency to the circles, of the radial pin path centerline as at 35, that is, of radii extending from the sector axis 31.

The positions of the tangents then represent the extreme sector positions, since the radii 28 from axis 29, which represent the respective corresponding positions of the spindle screw centerline 28, are then perpendicular to those tangents.

Considering the largest pin orbit circle in FIG. 7, that is, with the crank pin 27 at its greatest spacing from the crank pin rotational axis represented in FIG. 7, the upper arc extends over an angle of 264° and the lower arc amounts to 96°. Hence the ratio of these arcs, 264/96 or 2.75/1, represents the time allocation in the cycle for web feed and for the stationary web condition.

In FIG. 7 by way of further examples, circles with upper arc angles of 240°, 218° and 190° thus lower arcs of 120°, 142° and 170° also are represented as established through rotation of the adjustment screw 28. Where the crank pin 27 has the smallest spacing from the axis 29 shown in FIG. 7, then the upper arc has become much smaller, 190° with a corresponding increase to 170° for the lower arc, and the ratio of the times in the cycle, allocated to web feed and web standstill, has dropped to about 1.1. Thus as the pin orbit radius, hence sector-swing, is made smaller, thereby decreasing the fed web length, the relative interval when the web is halted becomes a larger part of the cycle, generally tolerable since the feed interval required for shorter lengths correspondingly decreases.

To obtain the maximum feed time for each of these and all other pin spacings, the coupling clutch and the brake then are actuated when the guide 35 reaches a position at a right angle to the screw 28; but by adjustably mounting the switches 56, 57, on the slide block, e.g., as described for switch 58, web feed can be shortened by establishing the time of clutching action initiation or termination or both with corresponding brake action, to occur later or earlier, or both, in the rightward swing of the sector.

The control circuitry as such, for the cluth and brake sections, may comprise basically conventional electromechanical or electronic circuit means for accepting a clutch activating and brake deactivating signal from switch 56, and then responsively cutting off power to the brake and providing clutch actuation power to 63, with maintenance of that power to 63; then accepting the brake activating and clutch deactivating signal from 57 to cut off electrical power to the clutch thereby releasing it and simultaneously supplying power to the brake to engage it and hold it engaged until another signal is received from switch 56 to begin the next cycle. The control circuitry, of course, will be adapted to the form of switches used and the character of the clutch and brake units, which need not be of the normally disengaged type above described for FIG. 2.

As previously described FIG. 1 and FIG. 3 show a further switch 58 secured on the slide block bracket 32*b*. This switch (see FIG. 1) preferably is secured by its mounting nuts in a bracket slot 60, so that it can be adjusted in its position relative to the switch activator 59. Switch 58 can serve to activate a photocell control or a like apparatus, sensing control index marks imprinted or otherwise provided on the web to cause actuation, when sensed, of mechanism in the machine to perform some operation on the web at a desired position relative to the mark.

By operation of switch 58, for example, a photocell device and control apparatus would first be made operative to sense and respond to marks on the web only when the web area, on which an operation is to be performed, such as transverse severance or severance-welding, is arriving at the work station. Thus only index marks present in that web region can be observed for control purpose, and printing or differences, appearing elsewhere along the web, cannot be sensed as though printed marks to cause an undesired response.

By adjustment of the position of switch 58, there is obtainable a selection of or a closer setting of the time when the photocell system becomes operative.

A similar adjustable mounting of switches 56 and 57 can be used to change the time of clutching or braking to some degree as another means of varying web feed length for example. Also a useful degree of switch action adjustment is available where the angular position of activator blade element 59 is settable; e.g., with plate 61 having a round margin where 59 is secured, and the latter slotted for the screw 59*a;* or with plate 61 not engaged in the slot 28, but held by a set screw in selected angular position on pin 27.

Thus through use of the described sector plate and crank disk arrangement, it is possible to have a longer time available for the web feed than for the web halt period during which the welding bar is in action. Through this disposition of the switches for actuation of the cluth and brake on the crank drive sector and so also a switch for refining the photocell control, a very exact operation is achievable even with high production rates by the bag machine. Also considerable flexibility of operation and control is possible. Indeed though sacrificing some advantages the rotation direction of disk 24 may be reversed and a web stand-still duration longer than the web feed time may be had, if for some particular application that be desirable.

What we claim is:

1. In a machine handling material to be processed at a work station in web form, and feeding the web to the work station intermittently by sections of a predetermined length, web feeding mechanism comprising:

a pair of web feed rolls intermittently rotationally driven to feed, in each period of rotation, a respective web section length;

a continuously rotationally driven crank disk bearing a crank pin;

means adjustably securing the crank pin on the disk at a selected radial distance from the disk rotational axis;

a lever arm pivotally mounted with pivot axis parallel to and eccentric to said disk axis, to oscillate over the disk;

a slide block supported on the lever arm to slide radially relative to the arm pivot axis, and having the crank pin pivotally engaged therein, whereby the arm is swung between two extreme positions with a longer time interval for the swing in one direction and a shorter time interval for the opposite swing in the other direction;

means for converting the oscillating motion of the said arm into derived rotational motion reversing in rotational sense with the swinging of the arm;

transmission means including alternately engaged clutch and brake means for transmitting to said rolls a rotational motion derived from the arm during one of said intervals by clutch engagement, and interrupting motion transmission to the rolls for the other interval by clutch disengagement with brake engagement;

said clutch and brake means comprising an electromagnetically actuated clutch, an electromagnetically actuated brake, and switch means supported on said slide block, and actuated upon the arm reaching the extreme positions of its oscillation for controlling the alternating engagement of the said clutch and brake.

2. In a machine with mechanism as described in claim 1, wherein said cluth engagement occurs during the longer of said intervals and the brake engagement during the shorter interval.

3. In a machine, a web feeding mechanism as described in claim 1, wherein said lever arm is a sector member having its pivot axis at the sector apex, and at its periphery a concentric sector rim;

a belt is anchored to the sector rim and reeved about a first wheel on a shaft serving as an input shaft for said clutch and a second wheel as an idler wheel;

said wheels being mounted outwardly adjacent the sector rim path and with axes parallel to the sector pivot axis;

thereby to provide motion converting means converting swing motion of the sector to rotary motion of the input shaft;

said clutch having an output shaft connected to said rolls, with said brake serving to brake the output shaft, whereby said transmission means is provided from said input shaft to said rolls.

4. A bag making machine, having a web feed mechanism as described in claim 3, wherein respective switches for actuation control of the clutch and brake are mounted on said side block on opposite sides of a sector radius through the crank pin axis, and on a line transverse to said sector radius;

said crank pin is supported on a sliding base engaged in a radial face slot of the crank disk;

said crank pin is adjustable in radial position by an adjustment spindle screw radially extending through and having a threaded engagement with the said base of the pin; and a switch actuating element for cooperation with said switches is secured on said base.

5. A bag making machine as described in claim 4, wherein a third switch is mounted on said slide block along said transverse line, at a position to be actuated by said actuating element for turning on or off a sensing device at the web path sensing control index marks borne by the web for controlling means carrying out an operation to be performed on the web.

6. A bag making machine as described in claim 5, wherein said control element is shiftably secured for position adjustment relative to said slide block.

7. A bag making machine as described in claim 6, wherein said switches are proximity switches.

8. A machine as described in claim 3, wherein said slide plate is slidably supported by two parallel guide rods extending therethrough and supported on the sector member to extend symmetrically parallel to a sector radial centerline.

9. A bag making machine with a web feeding mechanism as described in claim 3, wherein said output shaft is connected to said rolls by a toothed belt and wheel transmission.

10. A bag making machine as described in claim 9, wherein said output shaft is a quill journalled intermediate its ends in a housing end wall and having the input shaft extending therethrough at both ends, said input shaft having an inboard end journalled in a housing end wall opposite the first said wall, said quill having an inboard end flange at a location spaced from each said wall, the outboard ends of the quill and input shaft bearing respective toothed wheels for toothed belts of the transmission to the rolls and of the motion converting means;

said clutch and brake being like electromagnetic coupling units disposed in the spaces between the flange and housing end walls, and having casings respectively to the input shaft inboard end and to the first said housing end wall, and both units having shiftable coupling members engaged with said flange axially shiftably but rotationally fixed with respect thereto.

11. A bag making machine as described in claim 9, wherein said crank disk is driven from an electric motor through a toothed belt and wheel transmission.

12. A bag making machine, with web feed mechanism as described in claim 3 wherein one end of said spindle screw is engageable by means for rotating the screw and thereby adjusting the crank pin relative to the disk axis.

13. A bag making machine as described in claim 12, wherein the said one end of the spindle screw bears a gear engageable by a manually actuatable element for rotating the spindle screw.

14. A bag making machine as described in claim 13, wherein the gear is a bevel gear and the manually actuatable element is a rotatable key engageably endwise in a guide hole of the disk and bearing a bevel gear meshable with the first bevel gear.

15. A bag making machine as described in claim 12, with said means for rotating the screw comprising:

a spindle gear secured on a radially outer end of said spindle projecting beyond the periphery of said disk, to transverse a circular path with rotation of the disk; and spindle gear engaging means mounted at a location adjacent said circular path, and selectively momentarily engageable with the spindle gear from either side of the plane of its circular path upon the spindle gear transitting the said location thereby to cause limited spindle rotation on each transit in a direction dependent upon the side from which momentary engagement is made, whereby the crank pin radial position may be adjusted while the crank disk is in operation;

said spindle gear engaging means having a neutral position at which it does not engage the transitting gear.

16. A bag making machine as described in claim 2, with said spindle gear is a spur gear; and said spindle gear engaging means comprising a toothed block shiftably mounted outwardly of said circular path and shiftable to and fro along a path parallel to the crank disk axis of rotation, said toothed block having opposed teeth located in a claw-like arrangement, on opposite sides of the plane of said circular path and spaced to enable a neutral position of the toothed block at which the spindle gear may transit between the teeth without engagement, and means biasing said toothed block toward said neutral position and manually actuatable selectively to shift the toothed block to effect tooth engagement with the spur gear from one or the other side of the circular path.

* * * * *